US011447322B2

(12) United States Patent
Bhat et al.

(10) Patent No.: US 11,447,322 B2
(45) Date of Patent: Sep. 20, 2022

(54) BEVERAGE CONTAINER

(71) Applicant: PepsiCo, Inc., Purchase, NY (US)

(72) Inventors: Advait Bhat, White Plains, NY (US); Bruno Telesca, Sandy Hook, CT (US); Marc T. Wiescinski, Downers Grove, IL (US)

(73) Assignee: PepsiCo, Inc., Purchase, NY (US)

( * ) Notice: Subject to any disclaimer, the term of this patent is extended or adjusted under 35 U.S.C. 154(b) by 307 days.

(21) Appl. No.: 16/282,063

(22) Filed: Feb. 21, 2019

(65) Prior Publication Data

US 2020/0270047 A1 Aug. 27, 2020

(51) Int. Cl.
*B65D 79/00* (2006.01)
*B65D 1/02* (2006.01)

(52) U.S. Cl.
CPC ..... *B65D 79/005* (2013.01); *B65D 1/0223* (2013.01)

(58) Field of Classification Search
CPC ..... A45F 3/20; B65D 1/0223; B65D 23/10; B65D 23/102; B65D 25/107; B65D 79/005; B65D 79/008; B65D 79/0084; B65D 2501/0027; B65D 2501/0036
USPC ..... 215/381, 383
See application file for complete search history.

(56) References Cited

U.S. PATENT DOCUMENTS

| | | | |
|---|---|---|---|
| D67,464 | S | 2/1925 | Johnson |
| D96,106 | S | 2/1935 | Fuerst |
| D104,342 | S | 5/1937 | Duncan et al. |
| D111,212 | S | 9/1938 | Meyer |
| D179,173 | S | 11/1956 | Wilson |
| D188,133 | S | 6/1960 | Bindman |
| D188,138 | S | 6/1960 | Bindman |
| D345,693 | S | 4/1994 | Edstrom |
| 5,704,503 | A | 1/1998 | Krishnakumar et al. |
| 5,704,504 | A | 1/1998 | Bueno |
| D393,802 | S | 4/1998 | Collette et al. |

(Continued)

FOREIGN PATENT DOCUMENTS

| | | |
|---|---|---|
| CO | 7094 | 8/2012 |
| JP | 1021603 | 7/1998 |

(Continued)

OTHER PUBLICATIONS

International Search Report and the Written Opinion of the International Searching Authority issued in International Application PCT/US2020/018827, dated Jun. 4, 2020, 8 pages.

*Primary Examiner* — Javier A Pagan
(74) *Attorney, Agent, or Firm* — Sterne, Kessler, Goldstein & Fox P.L.L.C.

(57) ABSTRACT

A beverage container that includes a base, a cylindrical sidewall extending from and integrally formed with the base, and an upper region extending from the sidewall and defining an upper opening. The beverage container includes a longitudinal axis extending in a direction from the base to the upper opening. The beverage container further includes a continuous channel formed in and extending around a circumference of the sidewall. The continuous channel is sinusoidal such that the continuous channel forms peaks and troughs. A height of the continuous channel as measured in a direction of the longitudinal axis from a peak to a trough is about 30% to 80% of a height of the sidewall, such that the continuous channels resists elongation of the beverage container in a direction of the longitudinal axis.

19 Claims, 5 Drawing Sheets

(56) References Cited

U.S. PATENT DOCUMENTS

| | | | | |
|---|---|---|---|---|
| D398,855 | S | 9/1998 | Ito | |
| D403,243 | S | 12/1998 | Takeuchi et al. | |
| D404,311 | S | 1/1999 | Zimmer et al. | |
| D412,085 | S | 7/1999 | Roush et al. | |
| D414,112 | S | 9/1999 | Waggaman et al. | |
| D415,413 | S | 10/1999 | Cummings | |
| D417,156 | S | 11/1999 | Veyssiere | |
| 6,036,037 | A | 3/2000 | Scheffer et al. | |
| D423,940 | S | 5/2000 | Chimetto | |
| D424,948 | S | 5/2000 | Ullmo | |
| D430,036 | S | 8/2000 | Steward et al. | |
| D432,018 | S | 10/2000 | Steward | |
| D434,272 | S | 11/2000 | Johansen et al. | |
| D447,061 | S | 8/2001 | Peck | |
| D463,292 | S | 9/2002 | Del Bianco | |
| 6,581,794 | B2 | 6/2003 | Boukobza | |
| D480,650 | S | 10/2003 | Moore et al. | |
| D491,071 | S | 6/2004 | Degeyter et al. | |
| D493,370 | S | 7/2004 | Kamineni et al. | |
| D494,473 | S | 8/2004 | Yourist | |
| D496,280 | S | 9/2004 | Mero et al. | |
| D503,309 | S | 3/2005 | Yu | |
| D503,341 | S | 3/2005 | Oelmotte | |
| D509,436 | S | 9/2005 | Mero et al. | |
| D509,746 | S | 9/2005 | Mero et al. | |
| D510,027 | S | 9/2005 | Zboch et al. | |
| D510,271 | S | 10/2005 | Mero et al. | |
| D515,933 | S | 2/2006 | Mero et al. | |
| D527,267 | S | 8/2006 | Zboch et al. | |
| D527,635 | S | 9/2006 | Zboch et al. | |
| D538,663 | S | 3/2007 | Kamineni et al. | |
| D559,694 | S * | 1/2008 | Le Bras-Brown | D9/538 |
| D561,597 | S | 2/2008 | Venkataraman et al. | |
| D570,224 | S | 6/2008 | Dellevigne | |
| D571,668 | S | 6/2008 | Dellevigne | |
| D596,040 | S * | 7/2009 | Lepoitevin | B65D 1/0223 D9/520 |
| D603,709 | S | 11/2009 | Lepoitevin | |
| D607,747 | S | 1/2010 | Cella | |
| D623,067 | S | 9/2010 | Lovelace, Jr. et al. | |
| D635,461 | S | 4/2011 | Inoi et al. | |
| D644,879 | S | 9/2011 | Hadley | |
| 8,556,098 | B2 | 10/2013 | Peykoff et al. | |
| D757,556 | S | 5/2016 | Lesueur | |
| D763,092 | S | 8/2016 | Darr | |
| D767,993 | S | 10/2016 | Joshi et al. | |
| D803,061 | S | 11/2017 | Darr | |
| D890,611 | S | 7/2020 | Bhat et al. | |
| 2003/0000911 | A1 * | 1/2003 | Kelley | B65D 1/44 215/381 |
| 2003/0015491 | A1 * | 1/2003 | Melrose | B65D 79/0084 215/381 |
| 2008/0093329 | A1 * | 4/2008 | Mooney | B65D 1/0223 215/379 |
| 2008/0179271 | A1 * | 7/2008 | Bangi | B65D 1/0284 215/40 |
| 2011/0127279 | A1 * | 6/2011 | Oshino | B65D 1/0223 220/673 |
| 2015/0008210 | A1 | 1/2015 | Oshino et al. | |
| 2016/0311570 | A1 | 10/2016 | Didier et al. | |

FOREIGN PATENT DOCUMENTS

| | | | | |
|---|---|---|---|---|
| JP | 2017/024776 | A | 2/2017 | |
| JP | 2017024776 | A * | 2/2017 | |
| WO | WO-9506593 | A1 * | 3/1995 | B65D 1/0223 |
| WO | WO DM/047535 | | 3/1999 | |
| WO | WO DM/052622 | | 6/2000 | |
| WO | WO DM/059103 | | 4/2001 | |
| WO | WO DM/062865 | | 1/2003 | |
| WO | WO-2013110631 | A1 * | 8/2013 | B65D 79/005 |
| WO | WO 2018/208906 | A1 | 11/2018 | |

* cited by examiner

BEVERAGE CONTAINER

FIELD

Embodiments described herein generally relate to a beverage container. Specifically, embodiments described herein relate to a beverage container having a sidewall with channels formed in the sidewall that are configured to limit or resist deformation of the beverage container.

BACKGROUND

Beverage containers composed of polyethylene terephthalate and other plastics are used for storing beverages, such as sports drinks, juices, water, and other types of beverages. Forming beverage containers from plastic materials is a cost-effective and convenient alternative to packaging beverages in glass or metal containers due to their light weight, transparency, and ease of production. However, such plastic beverage containers may be susceptible to deformation when exposed to high temperatures or changes in pressure.

BRIEF SUMMARY OF THE INVENTION

Some embodiments are directed to a beverage container that includes a base, a cylindrical sidewall extending from and integrally formed with the base, and an upper region extending from the sidewall and defining an upper opening. The beverage container may include a longitudinal axis extending in a direction from the base to the upper opening. A continuous channel may be formed in and extend around a circumference of the sidewall, and the continuous channel may be sinusoidal such that the continuous channel forms peaks and troughs. A height of the continuous channel as measured in a direction of the longitudinal axis from a peak to a trough may be about 30% to 80% of a height of the sidewall so as to resist elongation of the beverage container in the direction of the longitudinal axis.

Some embodiments are directed to a beverage container that includes a base, a cylindrical sidewall extending from and integrally formed with the base, and an upper region extending from the cylindrical sidewall and defining an upper opening. Diagonal channels may be formed in the sidewall and extend at an oblique angle relative to a plane transverse to a longitudinal axis of the beverage container. The diagonal channels may be spaced along a circumference of the sidewall to resist deformation of the beverage container in a direction of the longitudinal axis of the beverage container and to resist paneling in shape of the sidewall. The beverage container may further include linear channel segments formed in the sidewall and extending along a circumference of the sidewall, wherein the linear channel segments resist paneling of the sidewall when an internal pressure of the beverage container is less than an external pressure.

Some embodiments are directed to a beverage container that includes a cylindrical sidewall and a continuous channel formed in and extending around the sidewall. The continuous channel may have a sinusoidal pattern with three peaks and three troughs such that the continuous channel resists elongation of the beverage container in a direction of a longitudinal axis of the beverage container.

In any of the various embodiments discussed herein, the continuous channel may be configured to resist elongation in a direction of the longitudinal axis when the beverage container is suspended from the upper region and is filled with a beverage having a temperature at or above a glass transition temperature of the beverage container.

In any of the various embodiments discussed herein, the beverage container may include a lower continuous channel and an upper continuous channel that are spaced from one another in a direction of the longitudinal axis of the beverage container. In some embodiments, each of the upper and lower continuous channels may include an upper bound defined as a plane transverse to the longitudinal axis at which the peaks are formed and a lower bound defined as a plane transverse to the longitudinal axis at which the troughs are formed, and the upper bound of the lower continuous channel may be above the lower bound of the upper continuous channel. In some embodiments, the lower continuous channel and the upper continuous channel may have the same dimensions. In some embodiments, the peaks of the lower continuous channel and the upper continuous channel may be aligned in a longitudinal direction of the beverage container.

In any of the various embodiments discussed herein, the continuous channel may include a diagonal region extending between a peak and a trough of the continuous channel that forms an angle with a plane transverse to the longitudinal axis of the beverage container of 40 to 50 degrees. In some embodiments, the angle may be 45 degrees.

In any of the various embodiments discussed herein, the beverage container may further include linear channel segments formed in the sidewall and extending around a portion of the circumference of the sidewall. In some embodiments, the linear channel segments may be arranged in one or more planes transverse to the longitudinal axis of the beverage container. In some embodiments, the linear channel segments may be spaced from the continuous channel. In some embodiments, the continuous channel may include an upper bound that is a plane transverse to the longitudinal axis and at which the peaks are formed, and a lower bound that is a plane transverse to the longitudinal axis and at which the troughs are formed, and wherein the linear channel segments may be positioned between the upper bound and the lower bound.

In any of the various embodiments discussed herein having diagonal channels, the diagonal channels may be arranged at an angle relative to a plane that is transverse to the longitudinal axis of the beverage container that is 40 to 50 degrees. In some embodiments, the diagonal channels may each have the same shape and dimensions. In some embodiments, each of the diagonal channels may have a first end opposite a second end, and a height of each of the diagonal channels measured in a direction of the longitudinal axis from the first end to the second end may be about 30% to 80% of a height of the sidewall of the beverage container. In some embodiments, the diagonal channels may be connected by peaks and troughs so as to form a continuous channel.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION OF THE INVENTION

Figure 1:
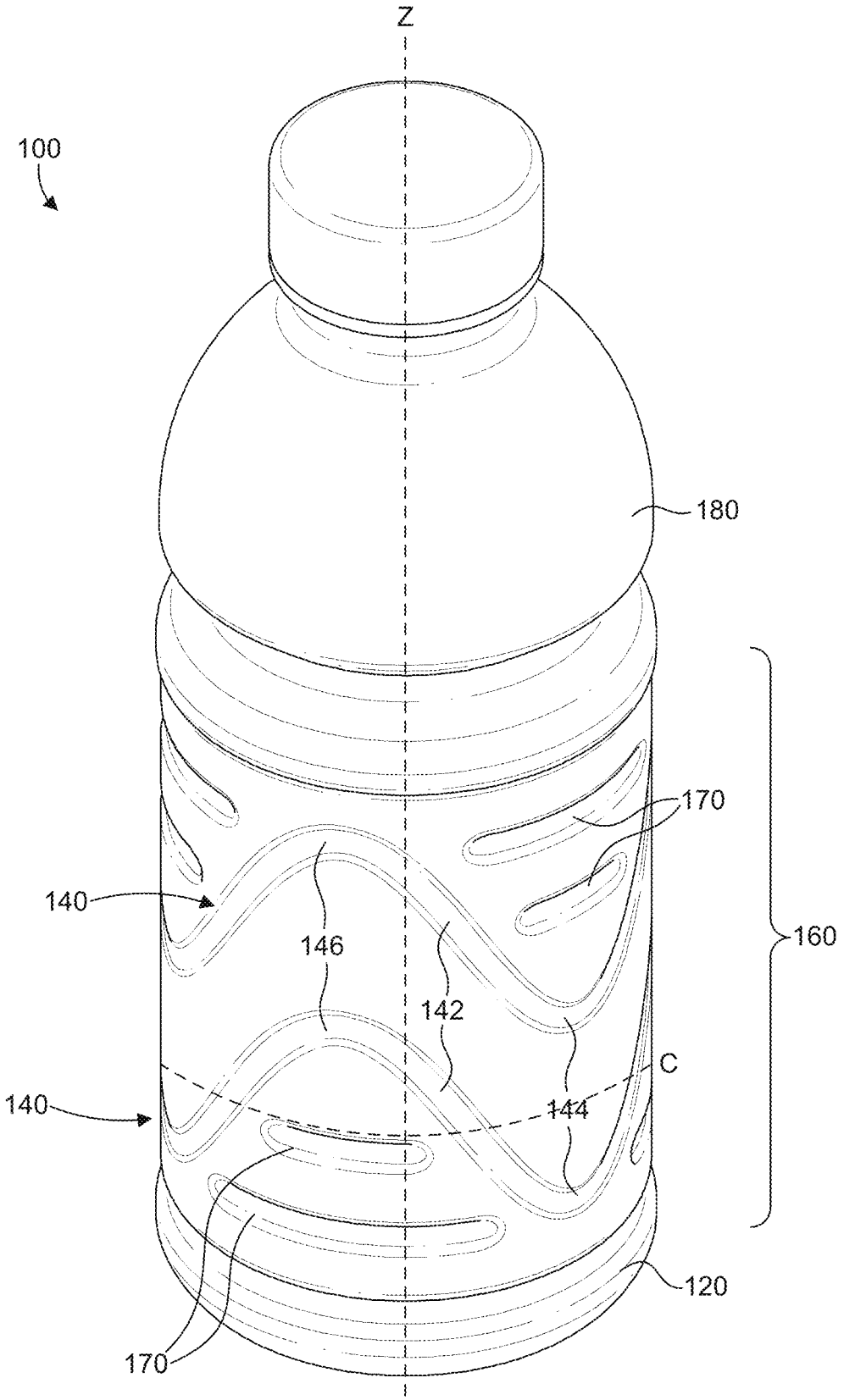
FIG. 1 shows a perspective view of a beverage container according to an embodiment.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

Beverage containers for storing various types of beverages may be composed of a plastic material, such as polyethylene terephthalate (PET), among others. Such plastic beverage containers often have a generally cylindrical construction. Plastic beverage containers may be filled with a beverage via a hot-filling operation. In a hot-filling operation, a beverage to be stored in the beverage container is heated to an elevated temperature, such as a temperature of about 170° F. or more, and deposited in the beverage container. The beverage container may be supported on a support surface during filling, or the beverage container may be suspended by an upper end, or neck, of the beverage container during filling. Once filled and capped, the beverage container and beverage therein are rapidly cooled. This cooling of the beverage may result in thermal contraction, which reduces the internal volume of the beverage container. To accommodate the resulting pressure differential, side walls of the beverage container may be pulled inward. Depending on the structure of the beverage container, including its sidewall, this can result in undesirable deformation, or "paneling" of the side wall, where a once-cylindrical sidewall takes on flattened or otherwise deformed shapes in order to accommodate the internal vacuum created by the reduction in volume of the beverage due to thermal contraction during cooling.

To help the beverage container to maintain its cylindrical shape throughout the process of filling the beverage container with a liquid and subsequently during storage and transportation of the beverage container, one or more ribs may be formed in the beverage container. The ribs may be formed on the beverage container as recessed (indented) channels that extend toward an interior volume of the beverage container and extend completely around the circumference of the beverage container in a plane transverse to a longitudinal axis of the beverage container. The ribs help to prevent the beverage container from paneling or otherwise deforming when an internal pressure of the beverage container is less than an external pressure. Such paneling may reduce the structural stability of the beverage container. Also, beverage containers that experience deformation may be unappealing to consumers, which may negatively impact sales of the beverage containers. While the ribs extending around a circumference of the beverage container may help to avoid paneling, the ribs may make the beverage container more susceptible to elongation in a longitudinal direction during certain types of filling operations.

As the beverage container is composed of plastic, the plastic may begin to deform if heated to a sufficiently high temperature, such as a temperature at or above the glass transition temperature of the beverage container. As a result, when the beverage container is suspended from its upper end or neck and is filled with a high temperature beverage, the weight of the beverage within the container and the heat may cause the beverage container to elongate in a longitudinal direction. Specifically, elongation may be most significant at the ribs of the beverage container, as the ribs may stretch or flatten, resulting in elongation of the beverage container.

Elongation of the beverage container may be undesirable because the elongation may result in beverage containers having different heights. Beverage containers having various heights may make it difficult to stack and store the beverage containers. For example, a case of beverage containers having varying heights may not evenly carry the load of another case of beverage containers stacked atop the first. The taller beverage containers may carry more of the load than the shorter ones, and may apply uneven pressure to the second case. This may make the second case sit unevenly on the first, making stacking and storage more difficult. This problem may compound as additional cases of beverage containers are stacked on top of one another.

In some embodiments described herein, a beverage container includes a sidewall with a channel formed in the sidewall having a sinusoidal shape that extends around a circumference of the beverage container. The channel helps to resist elongation of the beverage container, such as during hot-filling operations, while also providing resistance to paneling. The sidewall of the beverage container may further include linear channel segments that extend along a portion of a circumference of the sidewall. The linear channel segments may provide further resistance to paneling.

In some embodiments, as shown, for example, in FIG. 1, a beverage container 100 includes a base 120, a sidewall 160 extending from and integrally formed with base 120, and an upper region 180 extending from and integrally formed with sidewall 160 and defining an upper opening. Beverage container 100 includes a longitudinal axis Z extending centrally in a direction from base 120 to upper region 180. Sidewall 160 is generally cylindrical such that beverage container 100 has a generally circular transverse cross section (not accounting for channels formed in sidewall 160).

One or more channels 140 are formed in sidewall 160 that serve to prevent or limit elongation of beverage container 100 in a direction of the longitudinal axis Z. Channels 140 are formed as recessed areas in sidewall 160 that extend toward an interior volume of beverage container 100. Channels 140 also serve to resist paneling of sidewall 160 (e.g., when an internal pressure of beverage container 100 is less than an external pressure) by contributing hoop strength to beverage container 100. Specifically, beverage container 100 is configured to resist elongation in a direction of longitudinal axis Z when beverage container 100 is suspended from upper region 180 and is filled with a beverage having a temperature at or above a glass transition temperature of the material forming beverage container 100 (e.g., PET).

In some embodiments, a continuous channel 140 is formed in sidewall 160 and extends around a circumference C of sidewall 160. In some embodiments, continuous channel 140 has a sinusoidal shape such that continuous channel 140 includes a series of alternating peaks 146 and troughs 144 separated by diagonal regions 142. Diagonal regions 142 may be generally linear or may have a slight curvature so as to be curvilinear. It is understood that diagonal regions 142 may necessarily have a slight curvature as diagonal regions 142 extend around a portion of cylindrical sidewall 160. Further, in some embodiments, diagonal region 142 may have a slight curvature as a diagonal region 142 approaches a peak 146 or a trough 144. In some embodiments, continuous channel 140 may form three peaks 146 (and thus three troughs 144). Some embodiments may include additional or fewer peaks 146, however, due to approach and passage through a transverse plane relative to longitudinal axis Z, peaks 146 and troughs 144 may be more susceptible to elongation than diagonal regions 142 of continuous channel 140. As a result, the susceptibility of beverage container 100 to elongation decreases as the number of peaks 146 (and troughs 144) is reduced.

Continuous channels 140 serve a dual purpose: to resist or prevent elongation of beverage container 100 in a direction of longitudinal axis Z during hot-filling operations, and to resist or prevent paneling of beverage container 100 when an internal pressure of beverage container 100 is less than an external pressure. As discussed, ribs (or channels) that extend circumferentially around the beverage container and that are oriented in or near a plane transverse to a longitudinal axis Z may be susceptible to elongation in the direction of longitudinal axis Z, because, for example, the weight of a high-temperature beverage will be directed in the direction of longitudinal axis Z, nearly perpendicularly to the ribs. However, diagonal regions 142 of continuous channel 140 are less susceptible to elongation because diagonal regions 142 are oriented at an angle relative to a transverse plane. As a result, when beverage container 100 is filled with a high-temperature beverage, beverage container 100 is less able to stretch longitudinally in diagonal region 142 of continuous channel 140. The weight of the high-temperature beverage (in the direction of longitudinal axis Z) will not be perpendicular to the direction of diagonal region 142 and will instead be at an angle thereto.

Further, as continuous channels 140 extend around a circumference C of sidewall 160, continuous channels 140 inhibit sidewall 160 from deforming, such as collapsing toward an interior of beverage container 100 when an internal pressure of beverage container 100 is greater than an external pressure. Thus, continuous channels 140 also help sidewall 160 to maintain a cylindrical configuration.

Figure 2:
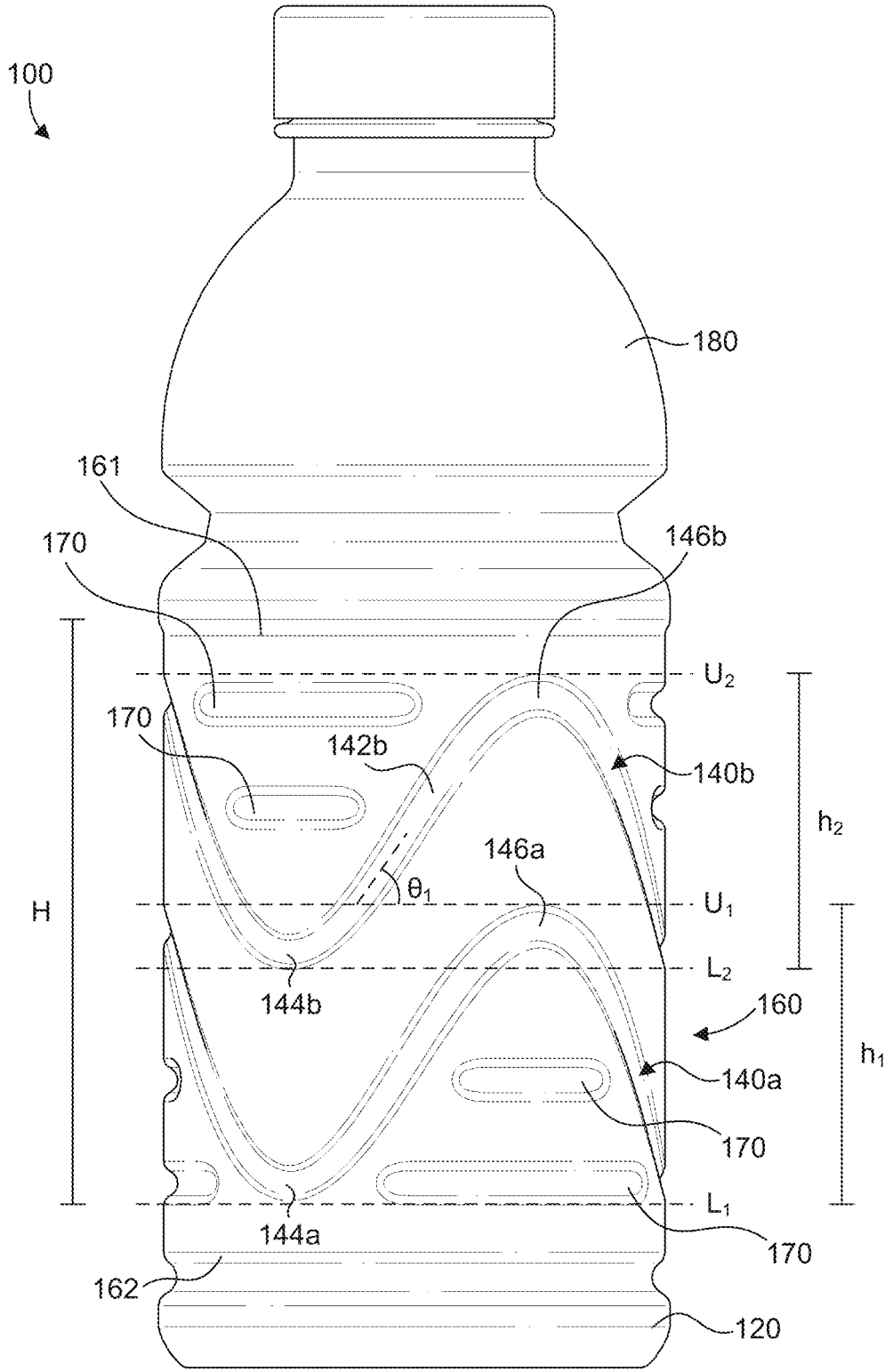
FIG. 2 shows a side view of a portion of a sidewall of a beverage container of FIG. 1.

As shown in FIG. 2, diagonal regions 142 of continuous channel 140 are formed at an angle $\theta_1$, relative to a plane that is transverse to longitudinal axis Z of beverage container 100. In some embodiments, angle $\theta_1$, may be, for example, 40 to 50 degrees. In some embodiments, the angle may be 45 degrees so as to balance resistance to paneling when beverage container 100 is subjected to a pressure differential and resistance to elongation during hot-filling operations. As angle $\theta_1$ decreases, such that continuous channel 140 is flattened and the sinusoidal pattern has a lower amplitude, the resistance to elongation provided by continuous channel 140 decreases while resistance to paneling increases.

Figure 3:
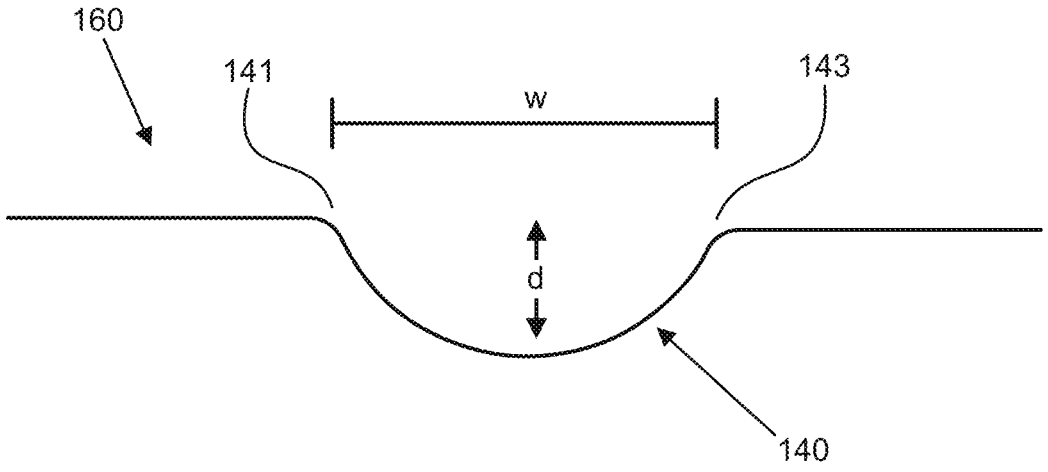
FIG. 3 shows a close-up cross sectional view of a channel of the sidewall of the beverage container of FIG. 1.

In some embodiments, channels 140 have a rounded indented surface, as shown for example at FIG. 3. Continuous channels 140 may take the form of a circular arc (e.g., a semi-circle) in cross section. However, channels 140 may have other cross-sectional shapes, for example a U-shape or parabolic cross-sectional shape, among others. In some embodiments, continuous channels 140 may have a width w as measured in a transverse direction of a channel 140 from a first side 141 to an opposing second side 143 of channel 140. Width w may be, for example, 4 mm to 8 mm. In some embodiments, continuous channels 140 may have a depth d as measured from a plane of sidewall 160 to a deepest portion of channel 140. Depth d may be, for example, 0.5 mm to 4 mm (e.g., 0.8 mm).

In some embodiments, continuous channels 140 have a circular-arc cross section based on a circle of 4 mm to 8 mm (e.g., 6 mm) diameter, with a depth d of 0.5 mm to 4 mm (e.g., 0.8 mm). As depth d of continuous channel 140 increases, the resistance of beverage container 100 to paneling increases. However, increasing depth d of channel 140 may make beverage container 100 more susceptible to elongation in a longitudinal direction. In some embodiments, all continuous channels 140 have the same cross-sectional size and shape.

In some embodiments, sidewall 160 is formed with two or more continuous channels 140*a*, 140*b*, such as a lower continuous channel 140*a* and an upper continuous channel 140*b*, as shown in FIG. 2. Lower continuous channel 140*a* and upper continuous channel 140*b* are spaced from one another in a longitudinal direction. In some embodiments, sidewall 160 may include three or more continuous channels 140. However, as the number of continuous channels 140 increases, the ability of beverage container 100 to resist elongation may decrease because peaks 146 and troughs 144 are more susceptible to elongation than diagonal regions 142 as discussed above, and thus additional peaks 146 and troughs 144 formed in additional continuous channels 140 may make beverage container 100 more susceptible to elongation.

In some embodiments, lower and upper continuous channels 140*a*, 140*b* may be formed with the same shape and dimensions. Thus, each channel 140*a*, 140*b* may be sinusoidal. Each channel 140*a*, 140*b* may have the same height as measured in a longitudinal direction from a trough 144 to a peak 146 of a continuous channel 140, and each channel 140*a*, 140*b* may have the same number of peaks 146 and troughs 144. The lower and upper continuous channels 140*a*, 140*b* may be in-phase with one another, such that peaks 146*a*, 146*b* of the lower and upper continuous channels 140*a*, 140*b* are aligned in the longitudinal direction of beverage container 100.

In some embodiments, each continuous channel 140 includes a lower bound L and an upper bound U, as best shown in FIG. 2. Lower bound L is a plane transverse to longitudinal axis Z of beverage container 100, and similarly upper bound U is a plane that is parallel to lower bound L and transverse to longitudinal axis Z. Each continuous channel 140 oscillates between its lower bound L and upper bound U. In some embodiments, each peak 146 of a continuous channel 140 is formed at upper bound U and each trough 144 is formed at lower bound L.

Each continuous channel 140 has a height measured in a direction of longitudinal axis Z from trough 144 to peak 146 (or lower bound L to upper bound U). Lower continuous channel 140 has a height $h_1$, and upper continuous channel 140*b* has a height $h_2$ that may be the same as $h_1$. In some embodiments, a height, $h_1$ or $h_2$, of each continuous channel 140 may be about 30% to about 80% of a height of sidewall 160. In some embodiments, each continuous channel 140 may be about 40% to about 70% of the height of sidewall 160. The height, H, of sidewall 160 is measured from a lower end 162 of sidewall 160 adjacent base 120 in a direction of longitudinal axis Z to an upper end 161 of sidewall 160 adjacent upper region 180.

In some embodiments, upper bound $U_1$ of a lower continuous channel 140*a* may be above lower bound $L_2$ of an upper continuous channel 140*b*. In this way, continuous channels 140*a*, 140*b* are spaced closely together such that a plane transverse to longitudinal axis Z intersects at least a portion of a continuous channel 140. In some embodiments, upper bound $U_1$ of lower continuous channel 140*a* may be at or below lower bound $L_2$ of upper continuous channel 140*b*.

Figure 4:
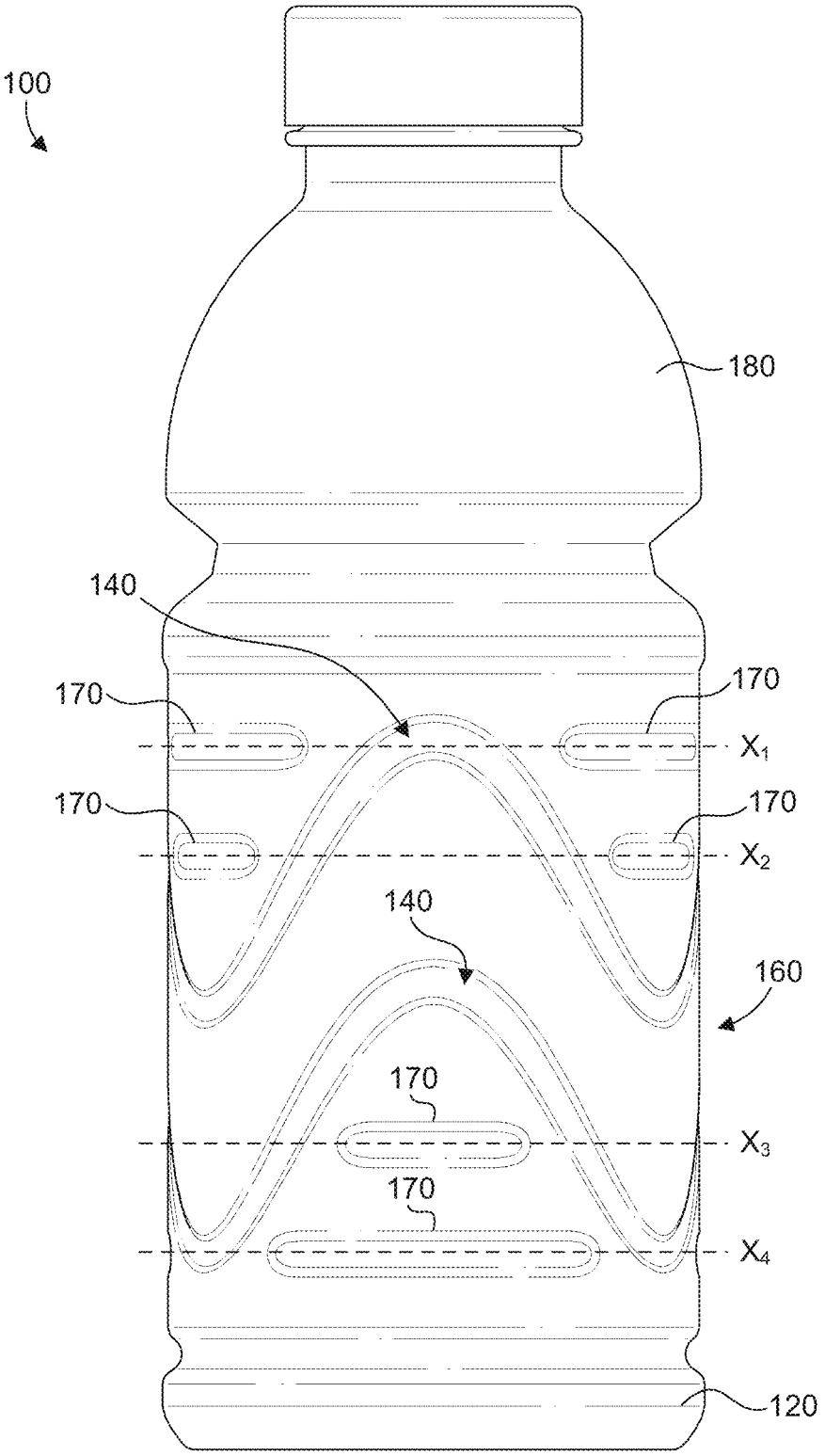
FIG. 4 shows a side view of a portion of a sidewall of a beverage container of FIG. 1.

In some embodiments, sidewall 160 of beverage container 100 further includes linear channel segments 170, as shown in FIG. 4. Linear channel segments 170 provide additional resistance to paneling of sidewall 160 of beverage container 100 when an internal pressure of beverage container 100 is less than an external pressure by contributing hoop strength to beverage container 100. Thus, linear channel segments 170 help sidewall 160 of beverage container 100 to retain its cylindrical shape throughout filling, transportation, and storage of beverage container 100.

Linear channel segments 170 extend around a portion of a circumference of sidewall 160. Similarly to continuous channels 140, linear channel segments 170 may be formed in sidewall 160 as recessed areas that extend towards an interior volume of beverage container 100. Linear channel segments 170 may be positioned in one or more planes, e.g., $X_1$, $X_2$, $X_3$ and $X_4$, that are transverse to longitudinal axis Z of beverage container 100. Each transverse plane may have multiple linear channel segments 170 that are spaced from one another around the circumference of sidewall 160. In some embodiments, a plane extending transversely to longitudinal axis Z may include four linear channel segments 170 spaced around the circumference of sidewall 160. Linear channel segments 170 in a particular plane may each be the same shape and dimensions. In some embodiments, linear channel segments 170 in a first plane $X_1$ may extend around a circumference to a greater extent than linear channel segments 170 arranged in a second plane $X_2$, such that the linear channel segments 170 in each plane differ in length. In some embodiments, linear segments 170 in different planes, e.g., plane $X_1$ and $X_2$, may be aligned on sidewall 160 along longitudinal axis Z.

Linear channel segments 170 may be formed in sidewall 160 in an area between a lower bound L and an upper bound U of a continuous channel 140, as shown in FIG. 2. Linear channel segments 170 are spaced from continuous channel 140 such that linear channel segments 170 do not intersect or overlap with continuous channel 140. Thus, linear channel segments 170 provide additional resistance to paneling in areas of sidewall 160 not occupied by continuous channels 140. As linear channel segments 170 do not extend continuously around circumference C of beverage container 100, linear channel segments 170 do not have a significant tendency to deform in the direction of longitudinal axis Z. The sidewall material that interrupts them constrains such deformation.

Linear channel segments 170 may have a rounded indented surface. Similar to continuous channels 140, linear channel segments 170 may take the form of a circular arc (e.g., a semi-circle) in cross-section. However, linear channel segments 170 may have other cross-sectional shapes, for example, a U-shape or parabolic cross-sectional shape, among others. Similar to the representation of continuous channel 140 shown in FIG. 3, in some embodiments, linear channel segments 170 have a width as measured in a transverse direction of a channel segment 170 from a first side to an opposing second side of channel segment 170. The width may be, for example, 4 mm to 8 mm (e.g., 5 mm to 7 mm). In some embodiments, linear channel segments 170 may have a depth as measured from a plane of sidewall 160 to a deepest portion of channel segment 140. The depth may be, for example, 2 mm to 4 mm (e.g., 3 mm).

In some embodiments, linear channel segments 170 have a semi-circular cross section with a diameter of 4 mm. In some embodiments, all linear channel segments 170 have the same cross-sectional size and shape. In some embodiments, each linear channel segment 170 may be formed with a deeper depth than depth d of continuous channel 140. In some embodiments, at least some linear channel segments 170 may have the same cross-sectional size and shape as at least some continuous channels 140.

Figure 5:
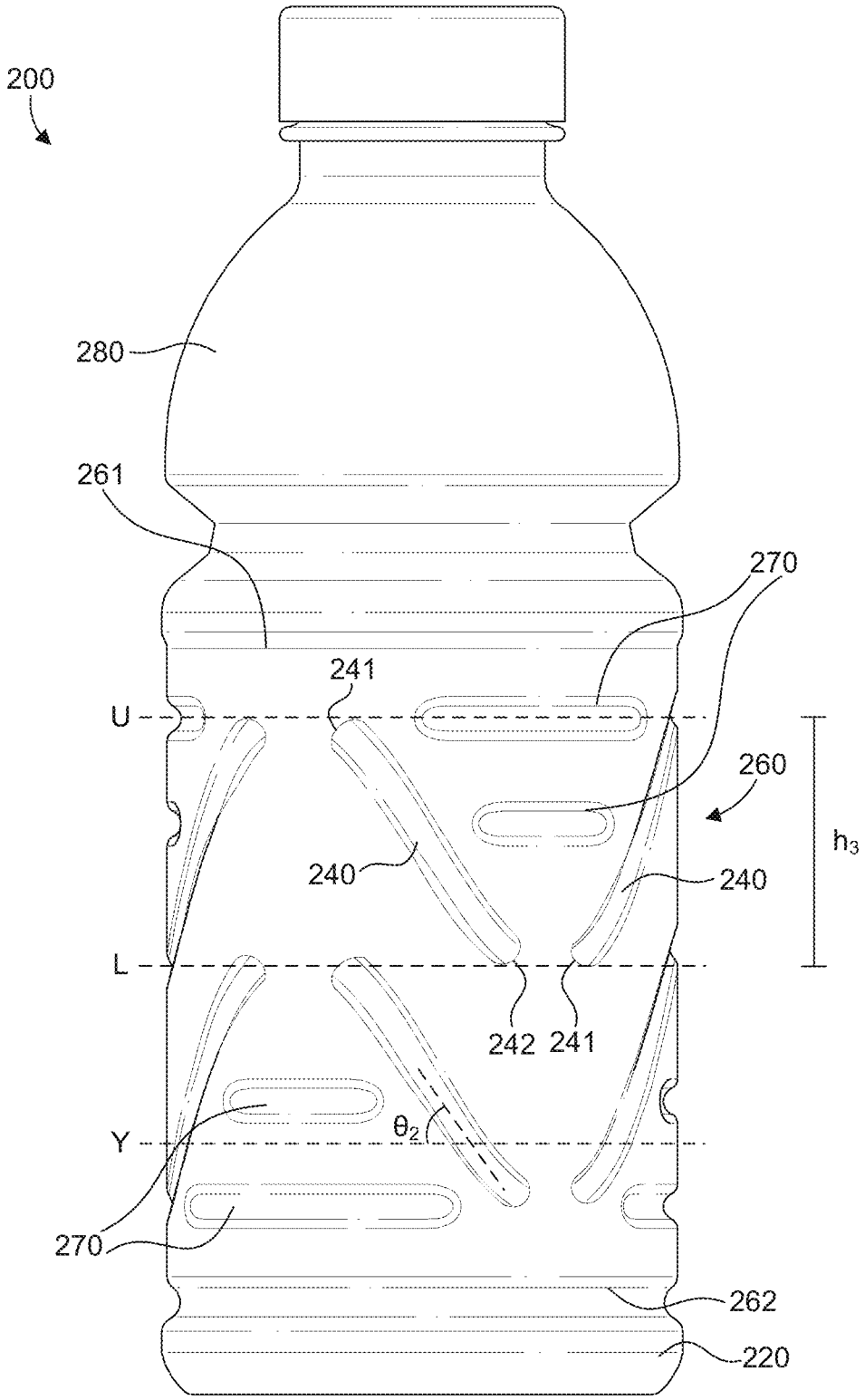
FIG. 5 shows a side view of a beverage container according to an embodiment.

In some embodiments, as shown in FIG. 5, a beverage container 200 includes a base 220, a sidewall 260 extending from and integrally formed with base 220, and an upper region 280 extending from and integrally formed with sidewall 260 and defining an upper opening. Beverage container 200 includes a longitudinal axis extending in a direction from base 220 to upper region 280. Sidewall 260 is generally cylindrical such that beverage container 200 has a generally circular transverse cross section. Thus, beverage container 200 is formed in the same manner as beverage container 100 and differs in that beverage container 200 includes a plurality of diagonal channels 240 formed in sidewall 260 and that are spaced around a circumference of sidewall 260. Each diagonal channel 240 may have the same shape and dimensions. In some embodiments, six diagonal channels 240 extend around a circumference of sidewall 260. In other embodiments, fewer or additional diagonal channels 240 may be formed in sidewall 260.

Similar to diagonal regions 142 of continuous channels 140 of beverage container 100 as shown in FIGS. 1, 2 and 4, diagonal channels 240 of beverage container 200 serve to resist or limit elongation of beverage container 200 in a longitudinal direction, such as during hot-filling operations. As discussed with respect to continuous channels 140 of beverage container 100, diagonal channels 240 also help to prevent paneling of sidewall 260 when an internal pressure of beverage container 200 is less than an external pressure, as diagonal channels 240 extend around the circumference of sidewall 260.

Diagonal channels 240 are oriented at an angle $\theta_2$ relative to a plane Y that is transverse to longitudinal axis Z. The angle may be, for example, 40 to 50 degrees. In some embodiments, the angle is 45 degrees. Further, each diagonal channel 240 may extend between a lower bound L defined as a plane transverse to a longitudinal axis of beverage container 200 and an upper bound U defined as a plane transverse to longitudinal axis that is parallel to lower bound L. A first diagonal channel 240 may have a first end 241 at an upper bound U and extends along sidewall 260 in a counter-clockwise direction to a second end 242 at a lower bound L, and an adjacent diagonal channel 240 may have a first end 241 at lower bound L and extends along sidewall 260 in a counter-clockwise direction to a second end 242 at upper bound U. In this way, diagonal channels 240 may form a discontinuous, wave-like pattern. In some embodiments, however, diagonal channels 240 may be connected, e.g., by connecting a second end 242 of a first diagonal channel 240 to a first end 241 of a second diagonal channel so as to form peaks and troughs, so as to form a continuous channel comprising diagonal channels 240 that extends around a circumference of sidewall 260.

Each diagonal channel 240 has a height $h_3$, measured in a direction of longitudinal axis Z from first end 241 to second end 242 (or from lower bound L to upper bound U). In some embodiments height $h_3$ of each diagonal channel 240 may be about 30% to about 80% of a height of sidewall 260. In some embodiments, each diagonal channel 240 may be about 40% to about 70% of the height of sidewall 260. The height of sidewall 260 is measured from a lower end 262 of sidewall 260 adjacent base 220 in a direction of the longitudinal axis to an upper end 261 of sidewall 260 adjacent upper region 280.

In some embodiments, diagonal channels 240 may have a cross sectional shape, width and depth as discussed above with respect to continuous channels 140. Thus, diagonal channels 240 may be radiused so as to have a rounded surface. Diagonal channels 240 may be generally semi-circular in cross section. However, diagonal channels 240 may have alternate cross-sectional shapes and may have a U-shape or parabolic cross-sectional shape, among others. In some embodiments, diagonal channels 240 may have a diameter or width of 4 mm to 8 mm. In some embodiments, diagonal channels 240 may have a depth of 0.5 mm to 4 mm, and in an embodiment the depth may be 0.8 mm. As the depth of diagonal channels 240 increases, the resistance of beverage container 200 to paneling increases. However, increasing depth of diagonal channel 240 makes beverage container 200 more susceptible to elongation in a longitudinal direction.

In some embodiments, sidewall 260 may include diagonal channels 240 extending around a circumference of sidewall 260 that are centered along two or more planes that are transverse to a longitudinal axis of beverage container 200. Thus, diagonals channels 240 may be arranged on sidewall 260 in two or more rows. Diagonal channels 240 in each row may be aligned in a longitudinal direction of beverage container 200.

In some embodiments, beverage container 200 may further include a plurality of linear channel segments 270 formed in sidewall 260 of beverage container 200. Linear channel segments 270 may be have the same shape, arrangement, and function as described above with respect to linear channel segments 170 of beverage container 100.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

The breadth and scope of the present invention(s) should not be limited by any of the above-described exemplary embodiments, but should be defined only in accordance with the claims and their equivalents.

What is claimed is:

1. A beverage container, comprising:

a base;

a cylindrical sidewall extending from and integrally formed with the base;

an upper region extending from the cylindrical sidewall and defining an upper opening, wherein the beverage container comprises a longitudinal axis extending in a direction from the base to the upper opening;

a continuous channel formed in and extending around a circumference of the cylindrical sidewall, wherein the continuous channel is sinusoidal such that the continuous channel forms peaks and troughs, wherein the continuous channel is configured to resist elongation of the beverage container in the direction of the longitudinal axis during a hot filling operation;

a first plurality of linear channel segments formed in the cylindrical sidewall in a first plane transverse to the longitudinal axis of the beverage container; and a second plurality of linear channel segments formed in the cylindrical sidewall in a second plane transverse to the longitudinal axis of the beverage container, wherein a linear channel segment of the first plurality of linear channel segments is aligned in the direction of the longitudinal axis with a linear channel segment of the second plurality of linear channel segments, and wherein a linear channel segment of the first plurality of linear channel segments has a first length in a circumferential direction, and a linear channel segment of the second plurality of linear channel segments has a second length in the circumferential direction that is different than the first length.

2. The beverage container of claim 1, wherein the continuous channel is configured to resist elongation in the direction of the longitudinal axis when the beverage container is suspended from the upper region and is filled with a beverage having a temperature at or above a glass transition temperature of the beverage container.

3. The beverage container of claim 1, comprising a lower continuous channel and an upper continuous channel that are spaced from one another in the direction of the longitudinal axis of the beverage container.

4. The beverage container of claim 3, wherein each of the upper and lower continuous channels includes an upper bound defined as a plane transverse to the longitudinal axis at which the peaks are formed and a lower bound defined as a plane transverse to the longitudinal axis at which the troughs are formed, and wherein the upper bound of the lower continuous channel is above the lower bound of the upper continuous channel.

5. The beverage container of claim 3, wherein the lower continuous channel and the upper continuous channel have the same dimensions.

6. The beverage container of claim 3, wherein the peaks of the lower continuous channel and the peaks of the upper continuous channel are aligned in the longitudinal direction of the beverage container.

7. The beverage container of claim 1, wherein the continuous channel comprises a diagonal region extending between a peak and a trough of the continuous channel that forms an angle of 40 to 50 degrees relative to a plane transverse to the longitudinal axis of the beverage container.

8. The beverage container of claim 1, wherein the first and second pluralities of linear channel segments are arranged above the continuous channel.

9. The beverage container of claim 1, wherein the first and second pluralities of linear channel segments are spaced from the continuous channel.

10. The beverage container of claim 1, wherein the continuous channel includes an upper bound that is a plane transverse to the longitudinal axis and at which the peaks are formed, and a lower bound that is a plane transverse to the longitudinal axis and at which the troughs are formed, and wherein the first and second pluralities of linear channel segments are positioned between the upper bound and the lower bound.

11. A beverage container, comprising:

a base;

a cylindrical sidewall extending from and integrally formed with the base;

an upper region extending from the cylindrical sidewall and defining an upper opening;

diagonal channels formed in the cylindrical sidewall and extending at an oblique angle relative to a plane transverse to a longitudinal axis of the beverage container, wherein the diagonal channels are spaced along a circumference of the cylindrical sidewall to resist deformation of the beverage container in a direction of the longitudinal axis of the beverage container and to resist paneling deformation in a shape of the cylindrical sidewall; and linear channel segments formed in the cylindrical sidewall and extending along the circumference of the cylindrical sidewall, wherein the linear channel segments each have a depth that is the same as or greater than a depth of the diagonal channels, and wherein the linear channel segments resist paneling of the cylindrical sidewall when an internal pressure of the beverage container is less than an external pressure.

12. The beverage container of claim 11, wherein the diagonal channels are arranged at an angle of 40 to 50 degrees relative to a plane that is transverse to the longitudinal axis of the beverage container.

13. The beverage container of claim 11, wherein each of the diagonal channels comprises a first end opposite a second end, and wherein a height of each of the diagonal channels as measured in a direction of the longitudinal axis from the first end to the second end is 30% to 80% of a height of the cylindrical sidewall of the beverage container.

14. The beverage container of claim 11, wherein the diagonal channels are connected by peaks and troughs and form diagonal regions of a continuous channel.

15. The beverage container of claim 11, wherein each of the linear channel segments has a rounded cross-sectional shape.

16. A beverage container, comprising:

a cylindrical sidewall; and a continuous channel formed in and extending around the cylindrical sidewall, wherein the continuous channel has a sinusoidal pattern comprising three peaks and three troughs, wherein the continuous channel further comprises a diagonal region between a peak and a trough, and wherein the diagonal region is arranged at an angle of 40 to 50 degrees relative to a plane that is transverse to a longitudinal axis of the beverage container such that the continuous channel resists elongation of the beverage container in a direction of the longitudinal axis of the beverage container.

17. The beverage container of claim 16, further comprising a first plurality of linear channel segments formed in the cylindrical sidewall in a first plane transverse to the longitudinal axis of the beverage container; and a second plurality of linear channel segments formed in the cylindrical sidewall in a second plane transverse to the longitudinal axis of the beverage container, wherein a linear channel segment of the first plurality of linear channel segments is aligned in the direction of the longitudinal axis with a linear channel segment of the second plurality of linear channel segments.

18. The beverage container of claim 16, further comprising linear channel segments formed in the cylindrical sidewall and extending along a circumference of the cylindrical sidewall, wherein the linear channel segments each have a depth that is the same as or greater than a depth of the continuous channel.

19. The beverage container of claim 17, wherein a linear channel segment of one of the first and second pluralities of linear channel segments has a depth that is the same as or greater than a depth of the continuous channel.

* * * * *